US012023572B2

(12) United States Patent
Bragg

(10) Patent No.: US 12,023,572 B2
(45) Date of Patent: Jul. 2, 2024

(54) ADJUSTABLE CUE BRIDGE

(71) Applicant: Dennis Edward Bragg, Chantilly, VA (US)

(72) Inventor: Dennis Edward Bragg, Chantilly, VA (US)

( * ) Notice: Subject to any disclaimer, the term of this patent is extended or adjusted under 35 U.S.C. 154(b) by 0 days.

(21) Appl. No.: 17/372,319

(22) Filed: Jul. 9, 2021

(65) Prior Publication Data

US 2022/0072411 A1 Mar. 10, 2022

Related U.S. Application Data

(60) Provisional application No. 63/049,957, filed on Jul. 9, 2020.

(51) Int. Cl.
*A63D 15/10* (2006.01)

(52) U.S. Cl.
CPC ..... *A63D 15/105* (2013.01)

(58) Field of Classification Search
CPC ..... A63D 15/105
USPC ..... 473/42
See application file for complete search history.

(56) References Cited

U.S. PATENT DOCUMENTS 196,568 A * 10/1877 Doughty ..... A63D 15/105 473/42
199,105 A * 1/1878 Prentice ..... A63D 15/105 473/42
453,797 A * 6/1891 Wickliffe ..... A63D 15/105 473/42
690,617 A * 1/1902 Ruhland ..... A63D 15/105 473/42
898,345 A * 9/1908 Franham ..... A63D 15/105 473/42
968,187 A * 8/1910 McIntire ..... A63D 15/105 473/42
2,014,788 A * 9/1935 Stickler et al. ..... A63D 15/003 473/42
2,817,525 A * 12/1957 Niemann ..... A63D 15/10 473/42
5,846,137 A * 12/1998 Tremblay ..... A63D 15/105 473/42
5,853,333 A * 12/1998 Patterson ..... A63D 15/105 473/42
6,929,555 B2 * 8/2005 Morton ..... A63D 15/105 473/42
8,870,669 B1 * 10/2014 Griffin et al. ..... A63D 15/105 473/42
9,539,492 B1 * 1/2017 Eager ..... A63D 15/006 473/42
2022/0072411 A1 * 3/2022 Bragg ..... A63D 15/105 473/42

FOREIGN PATENT DOCUMENTS

GB 2151932 A * 7/1985 ..... A63D 15/105
GB 2196867 A * 5/1988 ..... A63D 15/105
GB 2235880 A * 3/1991 ..... A63D 15/105

* cited by examiner

*Primary Examiner* — Mitra Aryanpour

(57) ABSTRACT

The Bragg Bridge is the only pool bridge that permits the height of the bridge head to be raised or lowered and tilted upward or downward thereby providing more support positions than conventional bridges; helping the player to avoid miscues or inadvertent contact or fouling the cue ball when attempting an over the ball shot, reducing the shot difficulty.

1 Claim, 4 Drawing Sheets

ADJUSTABLE CUE BRIDGE

FIELD

The Bragg Bridge is both a vertically adjustable, and angling adjustable pool bridge that will assist the pool player in the sport. The Bragg Bridge permits the height of the bridge to be raised and lowered to the desired position. While also tilting and swiveling into the perfect angle for the pool shot to be made.

BACKGROUND

The game of pool is a wonderful sport that is enjoyed by those of all ages, the professional and the amateur. However, when the balls are in difficult positions the use of the conventional pool bridge to reach that tough pool shot can be impracticable. When the cue ball is in close proximity to a cluster of object balls, it can be difficult to get a clean shot. The Bragg Bridge solves this problem by giving the shooter a higher angle to reach the shot and thereby reducing the chance to inadvertently cause a foul. The Bragg Bridge with its rotating head and adjustable height features will be a great asset to pool players of all ages.

SUMMARY

The Bragg Bridge is the only pool bridge that adjusts in height, and swivels and tilts to achieve a better angle at which to execute the shot. The telescopic leg with tripod feet, raises and lowers the bridge head to the desired height, while the rotating ball connector allows the head to be tilted up to a 360% angle.

Thereby providing more shot support angles than conventional pool bridges. This bridge helps pool players avoid fouling or inadvertently fouling the cue ball when attempting to shoot over an object ball, thereby reducing the shot difficulty.

BRIEF DESCRIPTION OF THE DRAWINGS

In the following detailed portion of the present description of the Bragg Bridge, the working function of the pool bridge will be explained in greater detail with reference to the Head/top, Rotating Ball Joint Connector/middle and Telescopic Leg with tripod feet/lower embodiments, shown in the drawings in which.

DETAILED DESCRIPTION

The Bragg Bridge can be constructed from several materials, including wood, metal, plastic or acrylic.

Head: (Top Embodiment)

Figure 1:
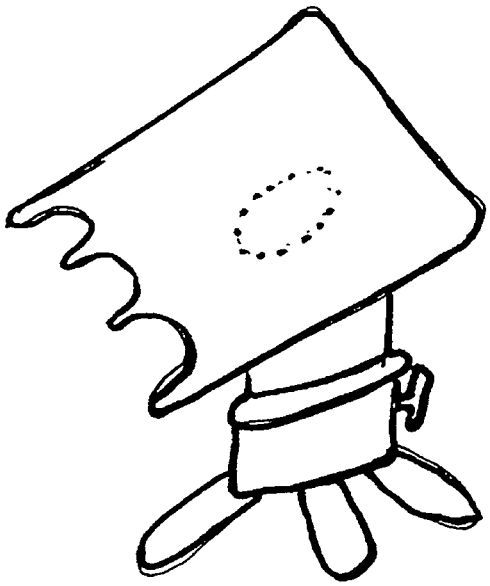
FIG. 1 is an isometric side view of the Bragg Bridge with its 3 embodiments.
Figure 2:
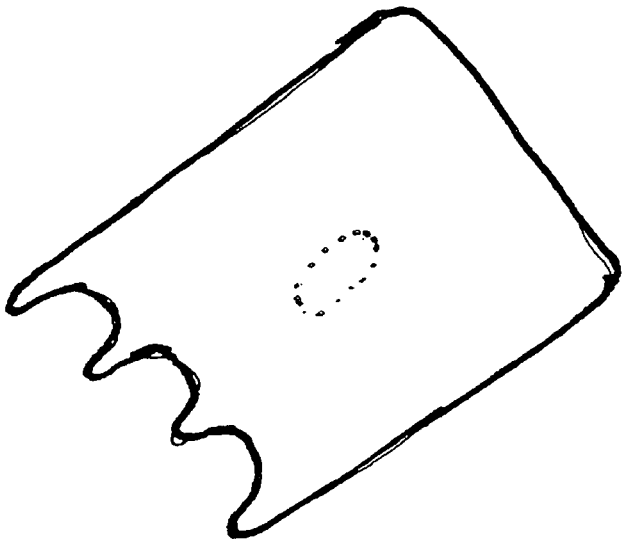
FIG. 2 is an isometric side view of the Bragg Bridge according to the Head/top section embodiment.

The first embodiment of the Bragg Bridge is the Head, illustrated in FIG. 2. The shape of the Head can be square or rectangular. The size can vary from approximately 4"×6" and up to 6"×6" inches. The thickness or depth of the square or rectangular Head is approximately one-quarter to one-inch thick. Three sides of the Head are straight, but the front side has three or more concave grooves, each approximately one-inch wide and two-inches deep. The grooves are used to guide the shaft of the pool cue while angling for the perfect pool shot. The square or rectangular Head in FIG. 2 lays flat on top of the Rotating Ball Joint Connector illustrated in FIG. 3.

Rotating Ball Joint Connector: (Middle Embodiment)

Figure 3:
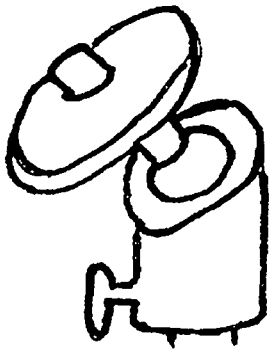
FIG. 3 is an isometric side view of the Bragg Bridge according to the Rotating Ball Joint Connector/middle embodiment. The side knob allows the ball joint connector to secure the head into the desired rotated position.

The middle embodiment of the Bragg Bridge is the Rotating Ball Joint Connector illustrated in FIG. 3. This ball jointed swiveling devise is attached to the center of the square or rectangular Head in FIG. 2, and allows the head to swivel and tilt in various directions, achieving up to 360% angles. The Rotating Ball Joint Connector in FIG. 3, allows the bridge head to tilt and swivel into the position the pool player desires for that perfect pool shot.

Telescopic Leg with Tripod Feet: (Lower Embodiment)

Figure 4:
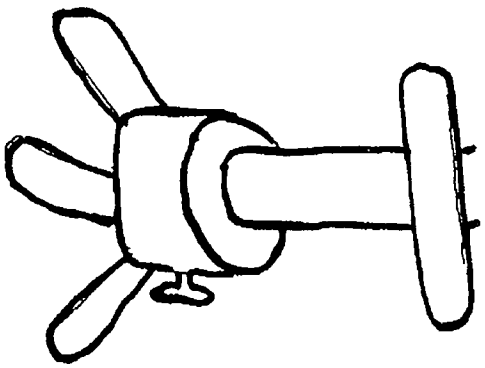
FIG. 4 is an isometric side view of the Bragg Bridge according to the Telescopic Leg with tripod feet/lower section embodiment, in an extended position. The side knob secures height positioning.

The telescopic leg with tripod feet illustrated in FIG. 4, is a height adjustable single leg with 3 feet extended out for support. This lower embodiment FIG. 4, allows the Head FIG. 2, to be adjusted anywhere from 4 to 10 inches in height, while the tripod feet keep the bridge stable on top of the pool table.

The invention claimed is:

1. An adjustable cue bridge device comprising:

a flat bridge-head having a plurality of concave openings formed in a front edge of the bridge head for receiving and guiding a cue stick;

a telescopic support having a tripod base, the telescopic support allowing height adjustment of the cue bridge device;

a ball joint positioned at an upper end of the telescopic support;

wherein the ball joint facilitates movement of the flat bridge-head from side-to-side and upward and downward.

* * * * *